United States Patent [19]

Hoskins et al.

[11] Patent Number: 4,519,449

[45] Date of Patent: May 28, 1985

[54] FLUID COUPLING AND METHOD OF ASSEMBLY

[76] Inventors: John T. Hoskins, 16 Cobblestone Ct., Orchard Park, N.Y. 14127; Robert G. Zillig, 4401 Overlook Dr., Williamsville, N.Y. 14221

[21] Appl. No.: 558,501

[22] Filed: Dec. 6, 1983

[51] Int. Cl.[3] ..... F28D 7/10

[52] U.S. Cl. ..... 165/141; 285/4; 285/161

[58] Field of Search ..... 165/141, 149, 154; 285/3, 4, 161, 277, 316, DIG. 2

[56] References Cited

U.S. PATENT DOCUMENTS

| | | | |
|---|---|---|---|
| Re. 13,485 | 11/1912 | Carlson | 285/4 |
| 2,793,830 | 5/1957 | Nakaji et al. | 285/161 X |
| 2,899,026 | 8/1959 | Hitch et al. | 188/264 |
| 2,935,339 | 5/1960 | Frederick | 285/4 |
| 3,420,497 | 1/1969 | Wilcox | 251/149.6 |
| 3,470,893 | 10/1969 | Nelson | 137/68 |
| 3,476,412 | 11/1969 | Demler, Sr. | 285/161 X |
| 3,649,053 | 3/1972 | Snyder, Jr. | 285/110 |
| 3,655,225 | 4/1972 | Major | 285/311 |
| 3,868,060 | 2/1975 | Mitchell | 237/12.3 B |
| 3,913,207 | 10/1975 | Frey | 29/413 |
| 4,022,497 | 5/1977 | Kotsakis | 285/4 |

FOREIGN PATENT DOCUMENTS

| | | | |
|---|---|---|---|
| WO81/01327 | 5/1981 | PCT Int'l Appl. | 165/149 |

*Primary Examiner*—Stephen F. Husar

*Attorney, Agent, or Firm*—Christel, Bean & Linihan

[57] ABSTRACT

A fluid coupling assembly 100 which is capable of interconnecting an oil cooler 26 disposed within a radiator header 12 with an oil line 130 terminating outside of said header. The coupling assembly includes a female fitting 106 which is capable of being brazed about a port in an oil cooler, the female fitting being provided with a threaded aperture which receives the externally threaded end of a male fitting 104. The male fitting is provided with an outwardly extending portion which is adapted to bear against one surface of a header wall, the female fitting 106 bearing, through a compressible washer 108, against the other surface of the wall 54. The male fitting is further provided with a circumferential groove in a cylindrical end portion which is capable of having a quick coupler 102 connected thereto. The quick coupler can be initially screwed onto the threaded end of an oil line 130.

32 Claims, 11 Drawing Figures

Fig. 2.
PRIOR ART
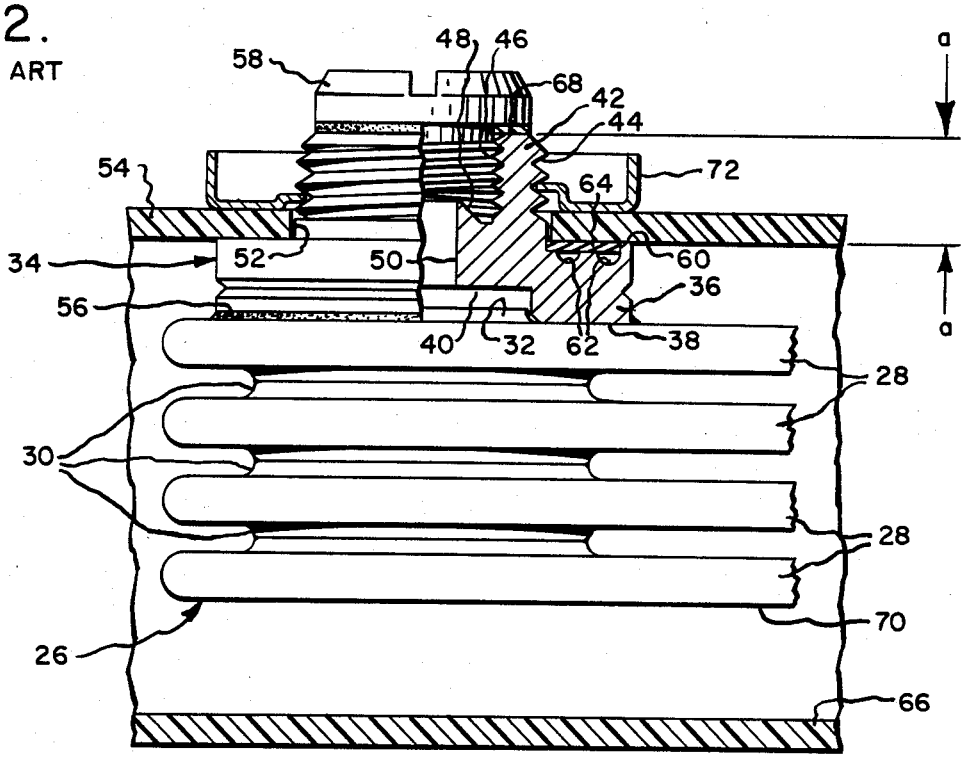
Fig. 4.
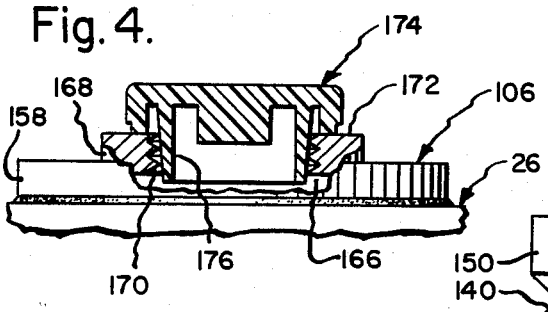
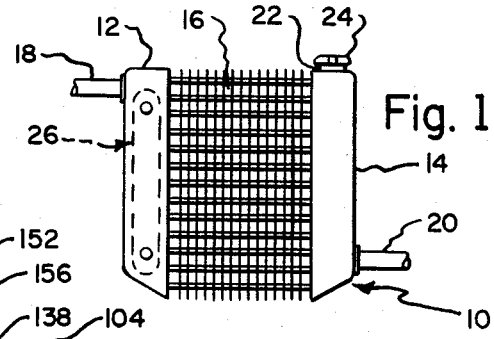
Fig. 1.
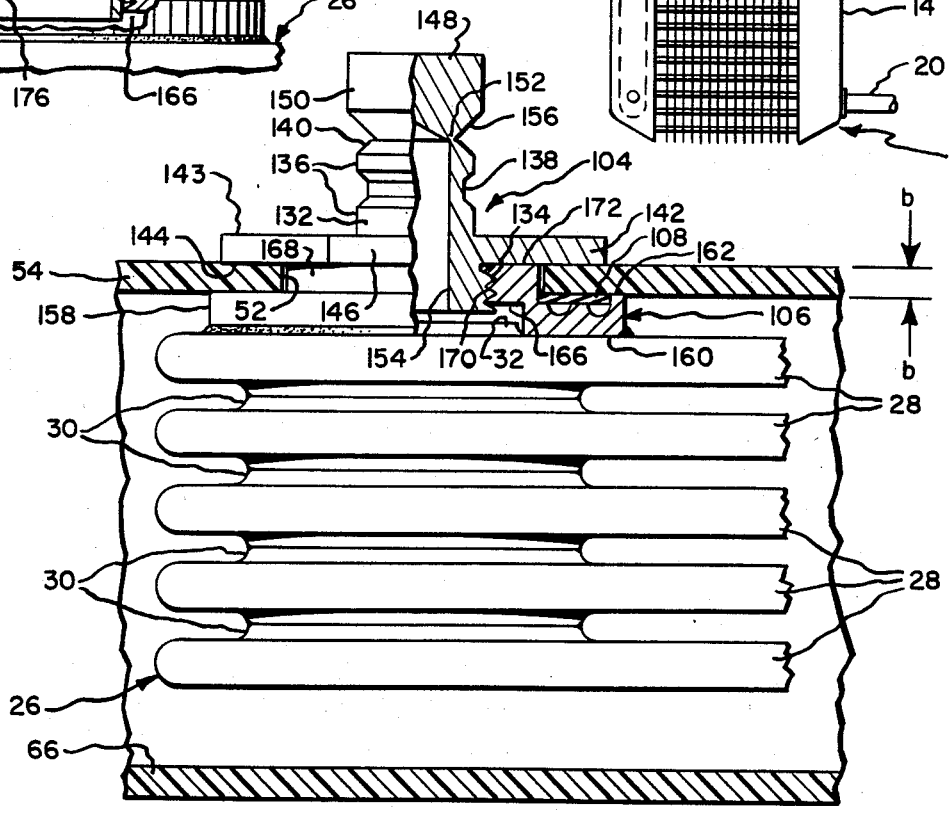
Fig. 3.

Fig. 5.
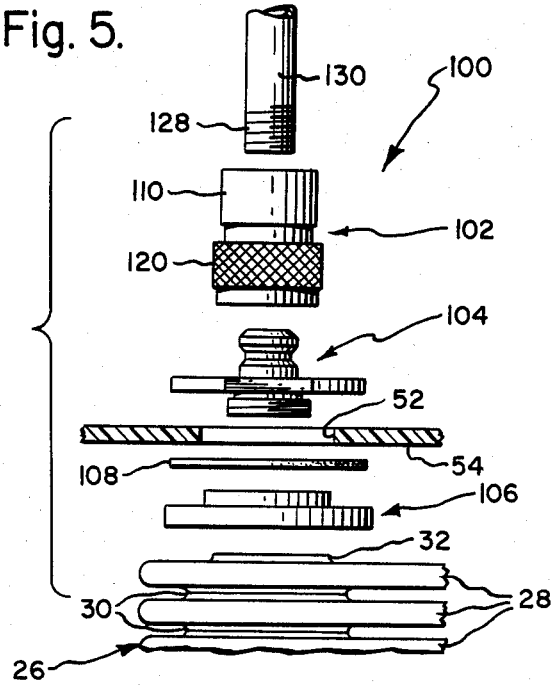
Fig. 11.
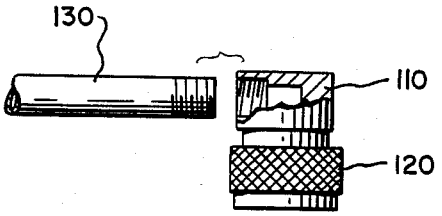
Fig. 6.
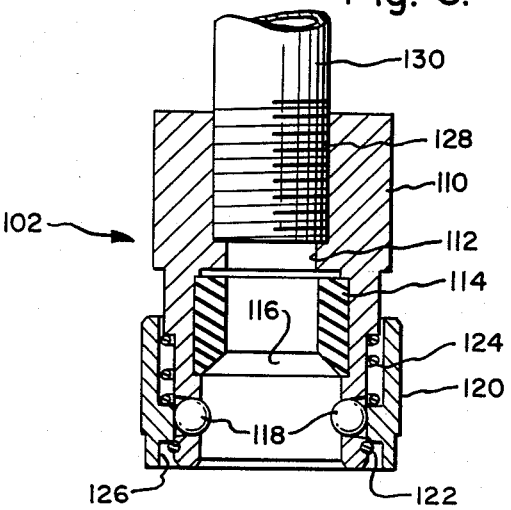
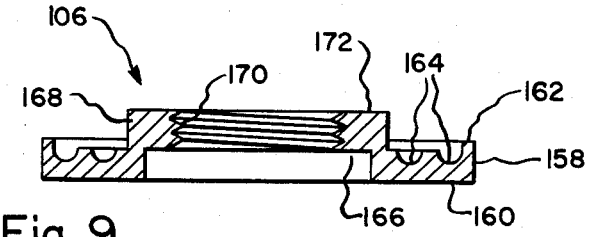
Fig. 9.
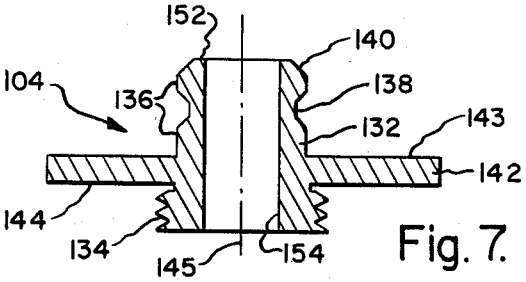
Fig. 7.
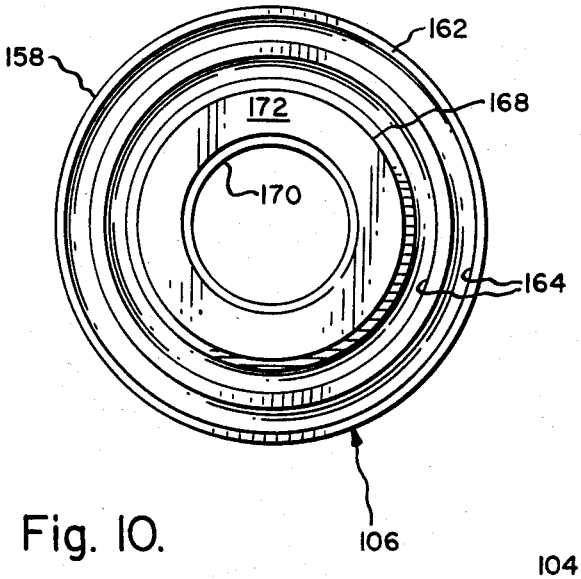
Fig. 10.
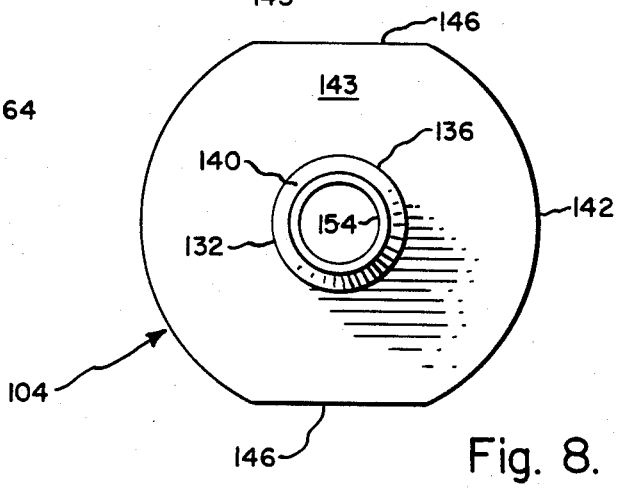
Fig. 8.

FLUID COUPLING AND METHOD OF ASSEMBLY

FIELD OF THE INVENTION

The present invention relates generally to a novel fluid coupling assembly which incorporates a novel fitting assembly, and also to a method of assembling the fluid coupling assembly to an oil cooler or the like which is disposed within a radiator or the like and also to an oil line or the like which is disposed outside of the radiator. This invention finds utility in the automotive industry where transmission oil coolers are frequently disposed within the radiator for a water cooled engine.

BACKGROUND

A typical automobile radiator consists of spaced apart inlet and outlet headers which are interconnected by a plurality of tubes which extend through a number of parallel fins over which ambient air is drawn by a fan (or by the forward movement of the automobile), the air serving to cool the engine coolant. If the automobile is provided with an automatic transmission, it may be necessary to provide a heat exchanger for cooling the transmission oil or fluid. In one form of transmission oil cooler an oil cooler is provided over which air may pass. In another form, which is more typical of many automobiles, the transmission oil cooler is actually disposed within one of the headers of the automobile radiator, and therefore the transmission oil is cooled by the engine coolant as it passes over this heat exchanger. To this end, a radiator which utilizes this form of transmission oil cooler is provided with a header having a pair of spaced apart apertures. The associated oil cooler is provided with fittings which extend through the apertures and to which oil lines may be secured directly.

In practice a number of disadvantages have been found with this prior art construction. One disadvantage is that, due to the height of the fitting, it is only possible to mount an oil cooler having four heat exchange plates within the typical automobile radiator header. Another disadvantage relates to the use of seal plugs. Thus, after assembly of the fitting to the oil cooler it is necessary to seal the oil cooler to prevent the introduction of foreign elements into the cooler. This is done by screwing threaded plugs into the oil cooler fittings. The oil cooler is subjected to a number of processing steps before final assembly into the radiator header. After final assembly the radiator is shipped to the assembly plant which may be many hundreds of miles away. At the final assembly location, it is then necessary to remove these plugs. It has been found in practice that it is frequently difficult to remove these plugs, which disassembly may take place many months after the plugs were installed. The labor costs associated with the removing of these plugs and the subsequent waste of these plugs is considered to be excessive. A further disadvantage relates to the subsequent servicing of the vehicle. Once the transmission oil line has been secured to the existing fitting of the prior art, it has been found that during servicing of the automobile that it is frequently necessary to cut the oil line in order to remove the radiator, as servicemen are reluctant to disconnect the end of the oil line from the radiator in view of a variety of problems. Finally, it has been noted that the existing fittings of the prior art, which are made of a ferrous material, will frequently corrode, and up to one-half of the anti-rust ingredient of the initial coolant fill will be utilized in overcoming the rust attributable to the transmission oil line fittings.

OBJECTS AND SUMMARY OF THE PRESENT INVENTION

It is an object of the present invention to provide a novel fluid coupling assembly which will overcome the disadvantages of the prior art, and more specifically which will permit the installation of oil coolers which have a greater number of heat exchange plates into existing radiator headers, which will permit the interconnection of oil lines to the oil cooler with a minimum of labor time, which will not corrode excessively after initial fabrication of the radiator assembly prior to final installation in the automobile, which does not require the utilization of machined capping plugs which are used to protect the interior of the oil cooler between its final assembly and its installation into an automobile, and which will also facilitate disconnection of the ends of the oil lines from the radiator to facilitate service of the radiator after final assembly.

The above objects and other objects and advantages of the present invention are accomplished by providing a novel fluid coupling assembly which includes a female fitting, a male fitting, and a quick disconnect coupling. The female fitting can be secured directly to the surface of a side wall of an oil cooler about an aperture therein, the female fitting being provided with a threaded neck portion which extends at least partially through an aperture in said side wall. The male fitting has one end which can be threaded into the female fitting, a break-off end plug at the other end, a radially outwardly extending nut or washer-like element adjacent the threaded end portion, and a cylindrical portion extending between the outwardly extending element and the break-off end plug, which cylindrically portion is provided with a groove for the reception of a quick disconnect coupling. The quick disconnect coupling can be secured to one end of an oil line, the quick disconnect coupling also being capable of being secured to the male fitting after the break-off end plug has been broken off.

The preceding objects and other objects and advantages of this invention will become more apparent after a consideration of the following detailed description taken in conjunction with the accompanying drawings in which a preferred form of this invention is illustrated.

BRIEF DESCRIPTION OF THE DRAWINGS

FIG. 1 is a rear view of an automotive radiator in which the principles of this invention may be embodied.

FIG. 2 is an enlarged cross-sectional view of a portion of a prior art radiator header in which an oil cooler is installed prior to final assembly.

FIG. 3 is a view similar to FIG. 2 but illustrating a novel fitting assembly of this invention.

FIG. 4 is a view similar to FIG. 3 but illustrating only the female fitting shown in FIG. 3, the female fitting being associated with a temporary closure device.

FIG. 5 is an exploded view of the fluid coupling assembly of this invention.

FIG. 6 is an enlarged cross-sectional view of the quick coupler shown in FIG. 5.

FIG. 7 is an enlarged cross-sectional view of the male fitting illustrated in FIG. 5.

FIG. 8 is a plan view of the male fitting shown in FIG. 7.

FIG. 9 is an enlarged cross-sectional view of the female fitting shown in FIG. 5.

FIG. 10 is a plan view of the fitting shown in FIG. 9.

FIG. 11 illustrates a quick disconnect coupling of the type which may be utilized in this invention, the quick disconnect coupling being adapted to receive an oil line extending at right angles to the axis of the quick disconnect coupling.

DETAILED DESCRIPTION

Referring first to FIG. 1 an automotive radiator is illustrated, this radiator being suitable for use with the present invention. The automotive radiator, which is indicated generally at 10, includes spaced apart left and right hand headers 12, 14, respectively. The heat exchanger element 16 of the radiator 10 extends between the headers 12 and 14 and consists of a plurality of parallel tubes and transverse fins, which fins are parallel to the headers 12 and 14. The headers are provided with cylindrical extensions to which radiator hoses 18 and 20 may be secured. The radiator is also closed by a radiator cap 24. While a transverse flow radiator has been illustrated, it should be appreciated that many radiators have vertically spaced apart headers interconnected by vertically extending tubes and the present invention is suitable for use with such radiators as well as the form shown in FIG. 1. As illustrated in FIG. 1 one of the headers may be provided with an oil cooler for cooling transmission oil, the oil cooler being indicated at 26. In FIG. 1 only one oil cooler 26 is illustrated, this oil cooler customarily being utilized for cooling transmission oil. However, it should be appreciated that the oil cooler 26 could be utilized for cooling other fluids, such as for example, engine oil for a diesel engine. In addition, it should also be appreciated that the radiator may be provided with more than one oil cooler, and thus, an oil cooler 26 may be provided in each header. Each header has opposed walls, and each header which is to receive an oil cooler has a pair of spaced apart apertures in one of its opposed walls.

One end of a prior art art oil cooler is illustrated in greater detail in FIG. 2. It can be seen that the prior art oil cooler consists of a plurality of spaced apart plate-like elements 28 which are interconnected at opposed ends by fluid passageway forming elements 30. Disposed above the fluid passageway forming elements 30 on the top plate is a locating flange 32 which is disposed about a port in the top wall of the top plate 28.

With further reference to FIG. 2 a portion of a prior art coupling device is illustrated. In this regard, it should be noted that the oil cooler 26 is provided with two coupling devices, one for an inlet oil line and one for an outlet oil line. The prior art fitting, which is indicated generally at 34, included a generally cylindrical portion 36 provided with a flat bottom surface and a lower recess 40 which was adapted to locate the cylindrical portion 36 relative to the locating flange 32 prior to brazing the fitting 34 to the top plate 28 of the heat exchanger 26. The prior art fitting 34 is also provided with a neck portion 42 provided with external and internal threads 44, 46, respectively. Disposed adjacent the internal threads 46 is an inverted flared portion 48 about which the flared end of an oil line is adapted to be secured. A bore 50 extends from the recess 40 through the inverted flared portion. The neck portion is adapted to be passed through a suitable aperture in a wall 54 of the header. To this end it should be noted that the spaced apart ports in the oil cooler are alignable with the spaced apart apertures 52 in the associated wall 54. The neck portion is also provided with a cylindrical portion 56 which is disposed between the cylindrical portion 36 and the external threads 44 for properly locating the fitting 34 within the aperture 52.

The prior art fittings 34 are preferably made of steel and after a pair of fittings 34 are placed on the top plate 28 of the oil cooler 26 and properly located, they are suitably brazed thereto by brazing material 56. After two fittings 34 have been brazed to the oil cooler 26 it is then necessary to pressure test the assembly for leaks. To this end a threaded plug 58 is inserted into one of the fittings 34 and suitable test apparatus is inserted into the other fitting 34 on the oil cooler. Fluid under pressure is then introduced into the oil cooler 26 to test for leaks. If no leaks are present the oil cooler is considered to have passed this inspection and the test apparatus is removed and another plug 58 is positioned within an associated fitting.

As can be seen, the cylindrical portion 36 is provided with a surface 60 opposite that of the bottom brazed surface 38, the surface 60 being provided with a pair of concentric inwardly spaced grooves 62. Prior to the assembly a compressible washer 64 is placed over the grooves 62. The oil cooler is than positioned within the header of the radiator. It should be appreciated that in order to assemble the oil cooler with the fitting 34 into the header it is first necessary to position the oil cooler with the plate 28 furthest away from the fitting 34 closely adjacent the wall 66 of the header, the wall 66 being opposite wall 54, in order to provide suitable clearance. Thus, the distance from the top surface 68 of the fitting to the bottom surface 70 of the lowermost plate is only slightly less than the distance between the inner surface of one wall 54 and the corresponding inner surface of the other header wall 66. Thus there must be a clearance between the bottom surface 70 and the adjacent surface of header wall 66 which is in excess of the height of the fitting 34 which extends through and above wall 54, this height being indicated by arrows a in FIG. 2. After the oil cooler 26 and fitting 34 have been positioned in the header with the fittings 34 projecting through apertures 52, the oil cooler is secured in place by nuts 72 the nuts being screwed down to cause them to bear against one surface 74 of the wall 54 and to cause the washer 64 to bear tightly against the other surface 76 of wall 54. At this time the radiator assembly is suitable for installation in an automobile. However, as the radiators for a number of different assembly plants are made at a common plant, it is necessary to ship the radiator to a different location. It is then necessary to remove plugs 58 prior to final assembly. As it is possible that some time may have elapsed, and that the radiator may have been subject to abuse during that period of time between completion and assembly it is frequently difficult to remove the plugs 58. Thus, it has also been found in practice that frequently an excessive amount of labor time is in fact required to remove the plugs from the fittings prior to final assembly. These plugs, which are a machined part, are not returned to the radiator plant but are thrown away.

While this prior art design has performed in a generally satisfactory manner in the past, other difficulties have also been encountered. Thus, as the parts 34 and 58 are made of ferrous material, frequently corrosion of these parts takes place to such an extent up to one-half of the anti-rust inhibitors in the initial coolant fill are consumed combating this corrosion. Finally, servicemen who are required to repair the automobiles after use are reluctant to disconnect the end of the oil line from fittings 34 and customarily cut the line when it is necessary to remove the radiator for service.

It should be appreciated from the above that while the prior art design has performed in a generally satisfactory manner, it has numerous shortcomings. The major shortcomings are the limitation on the number of plates which the oil cooler can be provided with due to the overall height of the fitting 34, the excessive labor required to remove the plug 58 at the final assembly location, the attendant waste of machined parts after the plugs 58 have been removed, and the difficulties encountered in servicing the vehicle after use by the owner/operator of the vehicle.

In order to overcome the disadvantages of the prior art construction, the novel fluid coupling assembly of this invention has been developed. Referring now to to FIG. 5 the fluid coupling assembly is indicated generally at 100 and consists of a quick disconnect coupling indicated generally at 102, a fitting assembly including a male fitting indicated generally at 104 and a female fitting generally at 106, and a compressible washer 108 disposable between the male and female fittings of the fitting assembly. The compressible washer 108 is of the same construction as the compressible washer 64 illustrated in FIG. 2.

The quick disconnect coupler 102 is of a generally conventional construction and is adapted to engage a cylindrical element provided with a circumferential groove. To this end the quick disconnect coupler includes a body 110 provided with a longitudinally extending bore 112 which is tapped or threaded at one end. The other end of the bore is of a greater diameter and receives a generally cylindrical seal 114 provided with a conical seating portion 116. The body is further provided with a plurality of recesses capable of receiving retaining balls 118. Typically, the body 110 will be provided with three or more ball receiving recesses. The balls are held in a coupling position such as that indicated in FIG. 6, by a slidable sleeve 120, which is held in its normal operable position by a retaining ring 122, the sleeve 120 normally being spring biased against the retaining ring 122 by a spring 124. It should be appreciated that if the sleeve 120 were moved in an upward direction as viewed in FIG. 6 against the action of the spring 124 that the balls could move radially outwardly into the enlarged cylindrical portion 126 of sleeve 120 to facilitate the installation or removal of the quick disconnect coupler. It should be appreciated that the threaded end 128 of an oil line 130 can be screwed into the tapped bore 112 in a fluid tight relationship.

To this end the threads may be provided with a curable pipe sealant which is capable of operating in the environment of the parts. Such a sealant could be Loctite brand PST pipe sealant which is a methyl acrylic ester provided with a teflon filler.

Referring now to FIGS. 7 and 8, the novel male fitting of this invention is illustrated. The male fitting 104 includes a generally cylindrical main body portion 132. The main body portion 132 has external threads 134 on one end thereof. The main body portion is provided with a further cylindrical end section 136 provided with a circumferentially extending groove 138 between the ends of the cylindrical end section 136, the cylindrical end section being provided with a conical end surface 140. The cylindrical end section and groove act as means which are capable of facilitating the interconnection of the oil line, through the quick coupler to the male fitting in a fluid tight relationship. Disposed between the externally threaded end 134 and the cylindrical end section 136 of the main body portion is a radially outwardly extending element 142. The element 142 is provided with two parallel surfaces 143, 144 which extend generally perpendicularly to the axis 145 of the generally cylindrical main body portion 132. The surface 144 is adapted to bear against the outer surface 74 of one wall 54 of the radiator header. The element is provided with opposed parallel flats 146 which will facilitate turning of the fitting 104 relation to the female fitting 106. It should be noted at this point when the male fitting is initially manufactured it is manufactured with a break-off end plug 148 which is shown in FIG. 3. The break-off end plug is provided with a cylindrical section 150, the cylindrical section 150 having a slightly larger diameter than the cylindrical end section 136 which will prevent the inadvertent connection of a quick disconnect coupler 102 to a male fitting 104 prior to the breaking off of the plug 148. It can be seen from an inspection of FIG. 3 that the conical end surface 140 extends radially inwardly between the cylindrical end section 136 and the break-off end plug 148. A cut surface 152 extends generally perpendicularly to the bore 154 which extends through the full length of the main body portion 132 and it extends radially inwardly from the terminal ends of the conical end surface 140. The plug 148 is provided with a radially inwardly extending conical surface 156 which terminates closely adjacent the bore 154 where it intersects the cut surface 152. It should be appreciated that by utilizing this design that the end plug 148 can be broken off from the main body portion 132 with only minimal burrs. One way of breaking off the plug 148 is to simply insert a closely fitting cylindrical element about the cylindrical section 150 and then applying a force at right angles to the axis of the cylindrical section to simply break off the plug. The purpose of the break-off end plug will be described in greater detail below. It should be noted that the break-off end plug 148 is initially integral with the male fitting and it caps the bore 154 adjacent the end surface 140.

Referring now to FIGS. 9 and 10, the female fitting 106 corresponds to a limited extent to the prior art fitting 34. Thus, the female fitting is provided with a radially outwardly extending cylindrical main body portion 158, the portion 158 having a flat surface 160 and another surface 162 parallel to the flat surface 160. As can be seen from a comparison of FIGS. 2 and 9 the height of the cylindrical portion 158, that is to say the distance between the surfaces 160 and 162 is considerably less than the corresponding distances in the prior art fitting illustrated in FIG. 2. Spaced inwardly of the surface 162 is a recessed portion provided with concentric grooves 164. The cylindrical portion 158 is provided with a recess 166 having a diameter suitable to facilitate the alignment of the female fitting 106 about the locating flange 32 on the upper plate 28 of an oil cooler 26. The female fitting is further provided with a neck portion 168 which is suitably apertured, the aperture being provided with internal threads 170. As can be seen the surfaces 160 and 162 extend generally perpendicularly to the threaded aperture 170, as does the surface 172 of the neck portion 168.

The fluid coupling assembly of this invention is coupled to an oil cooler in the following manner. Initially the oil cooler receives the female fittings 106 about the spaced apart locating flanges 32 which define two spaced apart ports in the oil cooler 26. The female fittings 106 are then suitably brazed to the top plate 28 of the oil cooler. After brazing, the interior of the oil cooler may be blocked off by either screwing in complete male fittings into the female fittings, or by the insertion of plastic caps of the form illustrated in FIG. 4. To this end each plastic cap, which is indicated generally at 174, is provided with a conical deformable projection 176 which can be readily screwed into the threaded aperture 170 of the female fitting. It should be noted though that the plastic caps are not suitable for the pressure test sequence and thus, when this sequence is performed it is desirable that a male fitting 104 be screwed into one of the female fittings 106, the male fitting being provided with the break-off end plug 148. Thus, during the pressure test sequence of the oil cooler 26 one male fitting 104 is screwed into one of the female fittings 106, and the test apparatus is screwed into the other female fitting 106 during testing. After the completion of the test sequence it would normally be desirable to remove the male fitting 104 and insert the plastic cap 174 until such time as the oil cooler 26 is to be assembled within the header of the radiator.

When the oil cooler 26 is to be assembled within the header it is first positioned into the header in the same manner as the prior art oil cooler 26. However, it should be noted that due to the reduced overall height of the fitting between the bottom surface 160 and the outermost surfaces 176 and the height of the neck portion, which is indicated by the arrows b, it is possible with the female fitting 106 of this invention to provide a five plate oil cooler 26 in the embodiments shown in FIG. 3 rather than the four plate oil cooler in the embodiment shown in FIG. 2. It should be noted though that prior to positioning the oil cooler 26 within the header that washers 108 are suitably located on the female fitting 106. After placement into the header the neck portion 168 of the female fittings 106 are positioned within the spaced apart apertures 52 of wall 54 and then the male fittings 104 are screwed into the female fitting causing the lowermost surface 144 of the element 142 to bear against the outer surface 74 of the wall 54 and similarly to cause the washer 108 to bear against the opposed surface 76 of the wall 54, the washer and threaded connection insuring a fluid tight connection. In this regard it should be appreciated that a suitable sealant such as Loctite brand PST pipe sealant may be applied to the threads 134 of the male fitting prior to that point where it is screwed into the threaded aperture in the female fitting. After the male fittings have been secured in place the radiator assembly can be shipped to the final assembly location. At the time of assembly it is then only necessary to break off the break-off end plugs 148, to screw the quick disconnect couplers onto the ends of the oil lines which are to be secured to the oil cooler, and then to secure the quick disconnect coupler to the cylindrical end section 136 of the male fitting. When this is done the seal 116 will bear against the conical surface 140 and provide a suitable fluid tight seal. The seal may be made of a fluoroelastomer such as VITON which is made by E. I. duPont, this being a high temperature oil resistant elastomer.

Due to the high brazing heat it is desirable that the female fitting 106 be made of a high temperature resistant material such as ferrous metal. However, in order to reduce corrosion during that period of time after the oil cooler has been assembled within the radiator, the male fitting 104 may be made of a non-corrosive material such as brass.

It should be apparent from a consideration of the above detailed description that the disadvantages of the prior art construction have been overcome by the novel fluid coupling assembly of this invention.

What is claimed is:

1. A fitting assembly for interconnecting an oil cooler disposed within a header to an oil line which terminates outside of said header, said oil cooler being provided with a port in one surface, and said header heaing provided with a wall having an aperture alignable with said port; said fitting assembly comprising:

a female fitting adapted to be connected to said oil cooler about said port, said female fitting having an aperture extending through its length, at least a portion of said aperture being threaded, and said female fitting further being provided with a neck portion disposable within the aperture of said header wall; and a male fitting having a main body portion provided with a bore extending its full length, one end of the main body portion being an externally threaded end which is screwed into the threaded aperture of the female fitting, and the other end of the main body portion being provided with means capable of facilitating the interconnection of one end of an oil line to the male fitting in a fluid tight relationship, and the male fitting further including a radially outwardly extending element disposed adjacent the threaded end, a surface of the radially outwardly extending element being capable of bearing against a surface of said header wall.

2. The fitting assembly as set forth in claim 1 wherein the female fitting is provided with a radially outwardly extending main body portion; and further characterized by the provision of a compressible washer disposed adjacent the radially outwardly extending main body portion of the female fitting, the compressible washer being held against another surface of said header wall in a fluid tight relationship when the threaded end of the male fitting is screwed into the female fitting.

3. A fitting assembly for a fluid coupling assembly, said fitting assembly comprising:

a female fitting adapted to be interconnected to an oil cooler or the like, said female fitting being provided with a threaded aperture and spaced apart generally parallel first and second surfaces extending generally perpendicularly to said threaded aperture, said female fitting further being provided with a neck portion extending outwardly of one of said surfaces, said threaded aperture being disposed at least in part within said neck portion; and a male fitting, one end of which is coupled to the female fitting and the other end of which is adapted to be interconnected to an oil line or the like, said male fitting including a generally cylindrical main body portion having an externally threaded end which is screwed into the threaded aperture of the female fitting, a cylindrical end section provided with an intermediate circumferential groove, and a radially outwardly extending element disposed between said threaded end and the cylindrical end section, said male fitting further being provided with a bore extending through the generally cylindrical main body portion, and said male fitting initially being provided with a break-off end plug which caps the bore at the end of the cylindrical end section, the break-off end plug being adapted to be broken off prior to the interconnection of one end of an oil line to the male fitting.

4. The fitting assembly as set forth in claim 3 wherein said male fitting is provided with a radially inwardly extending conical surface disposed between the cylindrical end section and the break-off end plug, and further characterized by the provision of a cut surface extending perpendicularly to said bore from the inner edge of the radially inwardly extending conical surface to a location relatively close to the surface of said bore to facilitate the breaking off of said break-off end plug.

5. The fitting assembly as set forth in claim 3 wherein the radially outwardly extending element of the male fitting is provided with at least a pair of opposed parallel flats to facilitate the screwing of the male fitting into the female fitting, said flats being parallel to the axis of said bore.

6. The fitting assembly as set forth in claim 3 wherein the diameter of the break-off end plug is greater than the diameter of the cylindrical end section.

7. The fitting assembly as set forth in claim 3 wherein said one surface of the female fitting is provided with a recessed portion capable of receiving a compressible washer.

8. The fitting assembly as set forth in claim 3 wherein the female fitting is made of a ferrous material and wherein the male fitting is made of brass.

9. A fitting for a fluid coupling assembly; said fitting comprising a generally cylindrical main body portion provided with a threaded end and a generally cylindrical end section which terminates in a radially inwardly extending conical surface, the generally cylindrical main body portion further being provided with a radially outwardly extending element disposed between the threaded end and the generally cylindrical end section, and a bore concentric with the main body portion and extending throughout its length; and a break-off end plug adjacent the radially inwardly extending conical surface, said plug being capable of initially capping the concentric bore, but, after being broken off, permitting essentially a full diameter passage from one end of the main body portion to the other end.

10. The fitting as set forth in claim 9 wherein the cylindrical end section is provided with means capable of facilitating the interconnection of one end of an oil line to the male fitting in a fluid tight relationship.

11. The fitting as set forth in claim 9 wherein the diameter of the break-off end plug is greater than the diameter of the cylindrical end section.

12. A fitting for a fluid coupling assembly, said fitting comprising a generally cylindrical main body portion provided with a concentric bore extending the full length of the main body portion, the generally cylindrical main body portion being provided with a radially outwardly extending element and a cylindrical end section having a circumferential groove formed therein, the end section terminating in a radially inwardly extending conical end surface, said fitting further being characterized by the provision of a break-off end plug adjacent the radially inwardly extending conical surface, said plug being capable of initially capping the concentric bore but, after being broken off, permitting essentially a full diameter passage from one end of the main body portion to the other end.

13. The fitting as set forth in claim 12 wherein the generally cylindrical main body portion is further provided with an externally threaded end adjacent the radially outwardly extending element.

14. The fitting as set forth in claim 13 wherein the diameter of the break-off end plug is greater than the diameter of the cylindrical end section.

15. The fitting as set forth in claim 13 wherein the end of the break-off end plug disposed adjacent the radially inwardly extending conical surface is provided with a second radially inwardly extending conical surface, which second radially inwardly extending conical surface terminates inwardly of the inner terminal edge of the first radially inwardly extending conical surface to provide a flat surface perpendicular to the axis of the generally cylindrical main body portion.

16. The fitting as set forth in claim 13 wherein the radially outwardly extending element is formed integrally with the generally cylindrical main body portion and includes two parallel surfaces extending generally perpendicularly to the axis of the generally cylindrical main body portion.

17. The fitting as set forth in claim 13 wherein the radially outwardly extending element is further provided with opposed parallel flats which extend between the parallel sides on the element, said flats being parallel to the axis of the generally cylindrical main body portion.

18. a method of securing a pair of oil lines to an oil cooler disposable within a radiator header, said header having a wall with a pair of spaced apart apertures, and said oil cooler also having a pair of spaced apart ports alignable with said pair of apertures in said header, said method comprising the following steps:

providing a pair of fitting assemblies and a pair of quick disconnect couplings, each of said fitting assembles including a main body portion and an integral break-off plug at one end of the main body portion, said plug terminating a bore which extends through the main body portion from the other end of the main body portion;

securing said other end of each of the fitting assemblies to spaced apart locations on the oil cooler to place said bores in communication with said spaced apart ports;

positioning the oil cooler within the header of the radiator with a portion of each of the fitting assemblies being received in said spaced apart apertures in the wall of said header;

securing said fitting assemblies to said wall;

breaking off the end plugs from the main body portions of said fitting assemblies; and securing one end of each of said quick disconnect couplings to an associated oil line which is to be secured to the fitting assemblies, and securing the other end of each of said quick disconnect couplings to said one end of the main body portion of one of said fitting assemblies.

19. A method of securing a pair of oil lines to an oil cooler disposed within the header of a vehicle radiator, said header having a wall with a pair of spaced apart apertures, and said oil cooler also having a pair of spaced apart ports alignable with said pair of spaced apart apertures in said header; said method comprising the following steps:

providing a pair of fitting assemblies and a pair of quick disconnect couplers, each fitting assembly including a female fitting provided with a threaded aperture, and a male fitting provided with a generally cylindrical main body portion having an externally threaded end and a bore extending throughout its length, the male fitting further being provided with a break-off end plug initially formed integrally with the cylindrical main body portion;

securing said pair of female fittings to spaced apart locations on said oil cooler about said ports by brazing or the like; positioning the oil cooler with the female fittings within the header of a radiator, a portion of each of the female fittings being received within corresponding apertures within one wall of said header;

securing said oil cooler to said wall of the header by screwing the male fittings into the female fittings;

breaking off said end plugs;

securing one end of said pair of quick disconnect couplers to the ends of the pair of oil lines which are to be secured to said oil cooler; and and securing the other end of the quick disconnect couplers to the male fittings adjacent that portion from which the break-off end plug has been broken off.

20. The method as set forth in claim 19 wherein a pair of washers are provided; and disposing said pair of washers between said pair of female fittings and said wall of said header.

21. The method as set forth in claim 19 further characterized by the steps of securing one of said pair of male fittings to one of said pair of female fittings after said female fittings have been brazed to said oil cooler;

connecting test apparatus to the other of said female fittings;

testing the integrity of said oil cooler;

removing the test equipment from said other of said female fittings; and removing said male fitting from said one female fitting prior to the installation of said oil cooler into said header.

22. The method as set forth in claim 19 further characterized by the provision of coating the threads of either the male or female fittings with a sealant immediately prior to that step wherein the male fittings are screwed into the female fittings.

23. A fluid coupling assembly connecting an oil cooler disposed within a header of a radiator to an oil line which terminates outside of said radiator, the header having at least one aperture in a wall thereof which receives a portion of said fluid coupling assembly, and said oil cooler having a port alignable with said aperture; said fluid coupling assembly comprising:

a first fitting connected to said oil cooler in fluid tight relationship about said port, said fitting having a first surface which bears against one side of said header wall, a threaded neck disposed at least in part within said aperture, and an aperture which extends through said neck and which is in fluid communication with said port;

a second fitting cioupled to the first fitting, said second fitting having a first surface which bears against the other side of said header wall, a threaded end which is coupled to the threaded neck, a cylindrical section provided with a circumferential groove therein, and a bore which extends through the threaded end and the cylindrical section; and a quick disconnect coupling having a body provided with a threaded bore, a seal, and means which engage said groove to dispose said seal and body in fluid tight relationship with said second fitting, one end of an oil line being screwed into said threaded bore in a fluid tight relationship.

24. The fluid coupling assembly as set forth in claim 23 wherein a compressible washer is disposed between the first surface of the first fitting and said one side of said header wall.

25. The fluid coupling assembly as set forth in claim 23 wherein the oil line extends away from the quick disconnect coupling at right angles thereto.

26. The fluid coupling assembly as set forth in claim 23 wherein the oil line extends away from the quick disconnect coupling coaxially thereto.

27. In combination with an oil cooler having a pair of ports, the oil cooler being disposed within a radiator header having a pair of apertures, and a pair of oil lines connectable to said oil cooler; the combination therewith of a pair of coupling assemblies, each of said coupling assemblies including a female fitting disposed within said header and secured to said oil cooler about a port, said female fitting being provided with a threaded aperture;

a male fitting secured to said female fitting and disposed on the outside of said header, said male fitting being provided with a bore which extends from the threaded aperture of the female fitting to an end surface of said male fitting, said male fitting being provided with a cylindrical end section adjacent said end surface, the cylindrical end section being provided with a circumferential groove; and a quick disconnect coupling provided with an oil passageway, said coupling being provided with means which engages the circumferential groove to hold said oil passageway in fluid tight relationship with the bore through the male fitting, said oil passageway further being provided with threads at one end thereof to which a threaded end of said oil line is secured.

28. The combination as set forth in claim 27 wherein the male fitting is initially provided with an integral break-off end plug of larger diameter than the cylindrical end section, said break-off end plug being broken off prior to securement with said quick disconnect coupling.

29. A heat exchanger sub-assembly comprising:

a radiator of the type having a header capable of receiving an oil cooler therein, said header having a wall provided with at least a pair of spaced apart apertures;

an oil cooler disposed within said header, said oil cooler being provided with a pair of spaced apart ports on one side thereof;

a pair of female fittings, each being provided with a threaded aperture, and each being secured to said oil cooler, the threaded aperture being coaxial with an associated port;

a pair of compressible washers, each being disposed between one of said pair of female fittings and a first surface of the header wall about an associated aperture;

a pair of male fittings, each having a main body portion provided with a threaded end screwed into the threaded aperture of an associated female fitting, a radially outwardly extending surface bearing against a second surface of the header wall, an end section provided with a radially inwardly extending conical surface and a bore which extends throughout the length of the main body portion, each male fitting further including a break-off end plug adjacent the radially inwardly extending conical surface, said plug being integral with said male fitting and capable of initially capping the bore disposed within the main body portion of the male fitting.

30. The heat exchanger sub-assembly as set forth in claim 29 wherein the end section is further provided with means capable of facilitating the interconnection of one end of an oil line to the male fitting in a fluid tight relationship after the break-off end plug has been broken off.

31. A heat exchanger assembly comprising:

a radiator of the type having a header capable of receiving an oil cooler therein, said header having a wall provided with at least a pair of spaced apart apertures;

an oil cooler disposed within said header, said oil cooler being provided with a pair of spaced apart ports on one side thereof;

a pair of female fittings each being provided with a threaded aperture, and each being secured to said oil cooler, the threaded aperture being coaxial with said associated port;

a pair of compressible washers, each being disposed between one of said pair of female fittings and a first surface of the header wall adjacent an associated aperture;

a pair of male fittings each having a main body portion provided with a threaded end screwed into the threaded aperture of an associated female fitting, a surface bearing against a second surface of the header wall, a cylindrical end section being provided with a circumferential groove therein and a bore extending from the threaded end through the cylindrical end section;

a pair of quick disconnect couplers, each being secured to an associated male fitting in fluid tight relationship thereto, and each of said quick disconnect couplers including a body having a bore therein, one end of said bore being threaded; and a pair of oil lines, each being screwed into the threaded bore of the body of an associated quick disconnect coupler.

32. A fluid coupling assembly adapted to connect an oil cooler disposed within a header of a radiator to an oil line which terminates outside the radiator, the header having at least one aperture in a wall thereof which is adapted to receive a portion of said fluid coupling assembly, the oil cooler having a port adapted to be aligned with said aperture, and said oil line terminating in a tubular connector end portion; said fluid coupling assembly comprising:

a tubular fitting, a first portion of which is adapted to be brazed to said oil cooler in fluid-tight relationship about said port, said fitting further including a second portion which adapted to be secured to said header in fluid-tight relationship within said aperture, the tubular fitting and the tubular connector end portion being adapted to be telescoped one within the other from a disassembled position to an assembled position;

an axially compressible tubular cylindrical seal mounted within one of either the tubular fitting or the tubular connector end portion and capable of being axially compressed when the tubular connector end portion and the tubular fitting are in their assembled position to provide a fluid-tight seal between said oil line and said oil cooler; and coupler means capable of holding the tubular fitting and the tubular connector end portion in their assembled position, said coupler means including an outwardly-extending surface mounted on one of either the tubular connector end portion or the tubular fitting, and said coupler means further including catch means mounted on the other one of either the tubular fitting or the tubular connector end portion, said catch means being adapted to be biased into locking engagement with said outwardly-extending surface when the tubular fitting and the tubular connector end portion are telescoped into their assembled position whereby the parts are held together in their assembled position.

* * * * *